United States Patent [19]

Ruthel et al.

[11] 3,944,479

[45] Mar. 16, 1976

[54] ANODE BASE STRUCTURE

[75] Inventors: Walter W. Ruthel, Grand Island; Leo G. Evans, Tonawanda, both of N.Y.

[73] Assignee: Hooker Chemicals & Plastics Corporation, Niagara Falls, N.Y.

[22] Filed: Jan. 3, 1974

[21] Appl. No.: 430,440

[52] U.S. Cl. ..... 204/297 R; 204/242; 204/252; 204/286

[51] Int. Cl.[2] ..... C25B 9/02

[58] Field of Search ..... 204/242, 252, 258, 266, 204/270, 278, 286, 297 R

[56] References Cited

UNITED STATES PATENTS

| | | | |
|---|---|---|---|
| 2,447,547 | 8/1948 | Stuart | 204/266 |
| 3,432,422 | 3/1969 | Currey | 204/266 X |
| 3,498,903 | 3/1970 | Kamarjan | 204/266 |
| 3,783,122 | 1/1974 | Sato et al. | 204/258 X |

FOREIGN PATENTS OR APPLICATIONS

| | | | |
|---|---|---|---|
| 1,125,493 | 8/1968 | United Kingdom | 204/266 |

*Primary Examiner*—John H. Mack
*Assistant Examiner*—W. I. Solomon
*Attorney, Agent, or Firm*—Peter F. Casella; Herbert W. Mylius

[57] ABSTRACT

A novel anode base structure is provided for an electrolytic cell which can enable the electrolytic cell to be designed to operate as a chlor-alkali diaphragm cell at high current capacities of about 150,000 amperes and upward to about 200,000 amperes while maintaining high operating efficiencies. These high current capacities provide for high production capacities which result in high production rates for given cell room floor areas and reduce capital investment and operating costs.

10 Claims, 6 Drawing Figures

ANODE BASE STRUCTURE

This Application is related to U.S. patent application Ser. No. 430,427, filed Jan. 3, 1974, now U.S. Pat. No. 3,859,196, which discloses an electrolytic cell provided with the anode base structure claimed in this application.

BACKGROUND OF THE INVENTION

This invention relates to a novel anode base structure for electrolytic cells suited for the electrolysis of aqueous solutions. More particularly, this invention relates to a novel anode base structure for electrolytic cells suited for the electrolysis of aqueous alkali metal chloride solutions.

Electrolytic cells have been used extensively for many years for the production of chlorine, chlorates, chlorites, hydrochloric acid, caustic, hydrogen and other related chemicals. Over the years, such cells have been developed to a degree whereby high operating efficiencies have been obtained, based on the electricity expended. Operating efficiencies include current, decomposition, energy, power and voltage efficiencies. The most recent developments in electrolytic cells have been in making improvements for decreasing the production capacities of the individual cells while maintaining high operating efficiencies. This has been done to a large extent by modifying or redesigning the individual cells and increasing the current capacities at which the individual cells operate. The increased production capacities of the individual cells operating at higher current capacities provide higher production rates for given cell room floor areas and reduce capital investment and operating costs.

In general, the most recent developments in electrolytic cells have been towards larger cells which have high production capacities and which are designed to operate at high current capacities while maintaining high operating efficiencies. Within certain operating parameters, the higher the current capacity at which a cell is designed to operate, the higher is the production capacity of the cell. As the designed current capacity of a cell is increased, however, it is important that high operating efficiencies be maintained. Mere enlargement of the component parts of a cell designed to operate at low curreent capacity will not provide a cell which can be operated at high current capacity and still maintain high operating efficiencies. Numerous design improvements must be incorporated into a high current capacity cell so that high operating efficiencies can be maintained and high production capacity can be provided.

Because the present invention may be used in many different electrolytic cells of which color-alkali cells are of primary importance, the present invention will be described more particularly with respect to chlor-alkali cells and most particularly with respect to chlor-alkali diaphragm cells. However, such descriptions are not to be understood as limiting the usefulness of the present invention with respect to other electrolytic cells.

In the early prior art, chlor-alkali diaphragm cells were designed to operate at relatively low current capacities of about 10,000 amperes or less and had correspondingly low production capacities. Typical of such cells is the Hooker Type S Cell, developed by the Hooker Chemical Corporation, Niagara Falls, New York, U.S.A., which was a major breakthrough in the electrochemical art at its time of development and initial use. The Hooker Type S Cell was subsequently improved by Hooker in a series of Type S cells such as the Type S-3, S-3A, S-3B, S-3C, S-3D and S-4, whereby the improved cells were designed to operate at progressively higher current capacities of about 15,000, 20,000, 25,000, 30,000, 40,000 and upward to about 55,000 amperes with correspondingly higher production capacities. The design and performance of these Hooker Type S cells are discussed in Shreve, *Chemical Process Industries*, Third Edition, Pg. 233 (1967), McGraw-HIll; Mantell, *Industrial Electrochemistry, Third Edition, Pg.* 434 (1950), McGraw-Hill; and Sconce, *Chlorine, Its Manufacture, Properties and Uses*, A.C.S. Monograph, Pp. 94–97 (1962), Reinhold. U.S. Pat. No. 3,987,463 by Baker et al. issued June 6, 1961, to Diamond Alkali discloses a chlor-alkali diaphragm cell designed to operate at a current capacity of about 30,000 amperes which is somewhat different than the Hooker Type S series cells. U.S. Pat. No. 3,464,912 by Emery et al. issued Sept. 2, 1969 to Hooker and 3,493,487 by Currey et al. issued Nov. 2, 1971 to Hooker disclose chlor-alkali diaphragm cells designed to operate at a current capacity of about 60,000 amperes.

The above description of the prior art shows the development of chlor-alkali diaphram cell design to provide cells which operate at higher current capacities with correspondingly high production capacities. Chlor-alkali diaphram cells have now been developed which operate at high current capacities of about 150,000 amperes and upward to about 200,000 amperes with correspondingly higher production capacities while maintaining high operating efficiencies.

SUMMARY OF THE INVENTION

In accordance with the present invention, there is provided a novel anode base structure for an electrolytic cell.

The novel anode base structure comprises a highly conductive metal means having a substantially flat and level surface and having a decreased cross-section as it extends away from the anode or intercell connecting busbar means to form the cross-sectional shape of a substantially stair-stepped truncated right triangle. The highly conductive metal means can be a solid metal plate having a configuration as described above or can be two or more highly conductive metal shapes, such as plates, having different relative dimensions and positioned in such a configuration whereby their cross-section form the cross-sectional shape of a substantially stair-stepped truncated right triangle as described above. The highly conductive metal means can be provided with means for attaching the anode blades. The highly conductive metal means has different relative dimensions and such a configuration whereby it is adapted to carry an electric current and to maintain a substantially uniform current density through the anode base structure to electrical contact points adjacent to the anode blades without any significant voltage drop across the anode base structure and with the most economical power consumption in the anode base structure.

The novel anode base structure can comprise suitable structural support means for the highly conductive metal means and any other suitable structural support means to provide the anode base structure with sufficient means to support other components of the electrolytic cell.

U.S. Pat. No. 3,432,422 by Currey issued Mar. 11, 1969 to Hooker is herein cited to show a state of the prior art.

The anode base structure makes the most economic use of invested capital, namely, the amount of highly conductive metal used in the anode base structure. The configuration and different relative dimensions of the highly conductive metal means significantly reduce the amount of highly conductive metal required in the anode base structure as compared to the prior art. The highly conductive metal means by means of its configuration and different relative dimensions is also adapted to carry an electric current and to maintain a substantially uniform current density through the anode base structure.

The anode base structure can be provided with an anode jumper busbar for attaching anode connector means when an adjacent electrolytic cell is jumpered and removed from the circuit. The anode base structure can also be provided with a cooling means to prevent temperatures in the anode base structure from rising to damaging levels and to further reduce the amount of highly conductive metal used in the anode base structure.

An electrolytic cell provided with the novel anode base structure of the present invention may be used in many different electrolytic processes. The electrolysis of aqueous alkali metal chloride solutions is of primary importance and the electrolytic cell of the present invention will be described more particularly with respect to this type of process. However, such description is not intended to be understood as limiting the usefulness of the anode base structure of the present invention or any of the claims covering the anode base structure of the present invention.

DESCRIPTION OF THE DRAWINGS

The present invention will be more fully described by reference to the drawings in which.

Two different types of metals are used to fabricate most of the various components or parts which comprise the novel anode base structure of the present invention. One of these types of metals is a high conductive metal. The other type of metal is a conductive metal which has good strength and structural properties.

The term highly conductive metal is herein defined as a metal which has a low resistance to the flow of electric current and which is an excellent conductor of electric current. Suitable highly conductive metals include copper, aluminum, silver and the like and alloys thereof. The preferred highly conductive metal is copper or any of its highly conductive alloys and any mention of copper in this application is to be interpreted to means that any other suitable highly conductive metal can be used in the place of copper or any of its highly conductive alloys where it is feasible or practical.

The term conductive metal is herein defined as a metal which has a moderate resistance to the flow of electric current but which is still a reasonably good conductor of electric current. The conductive metal, in addition, has good strength and structural properties. Suitable conductive metals include iron, steel, nickel and the like and alloys thereof such as stainless steel and other chromium steels, nickel and steels and the like. The preferred conductive metal is aa relatively inexpensive low-carbon steel, hereinafter referred to simply as steel, and any mention of steel in this application is to be interpreted to mean that any other suitable conductive metal can be used in the place of steel where it is feasible or practical.

The highly conductive metal and the conductive metal should have adequate resistance to or have adequate protection from corrosion during operation of the electrolytic cell.

Figure 1:
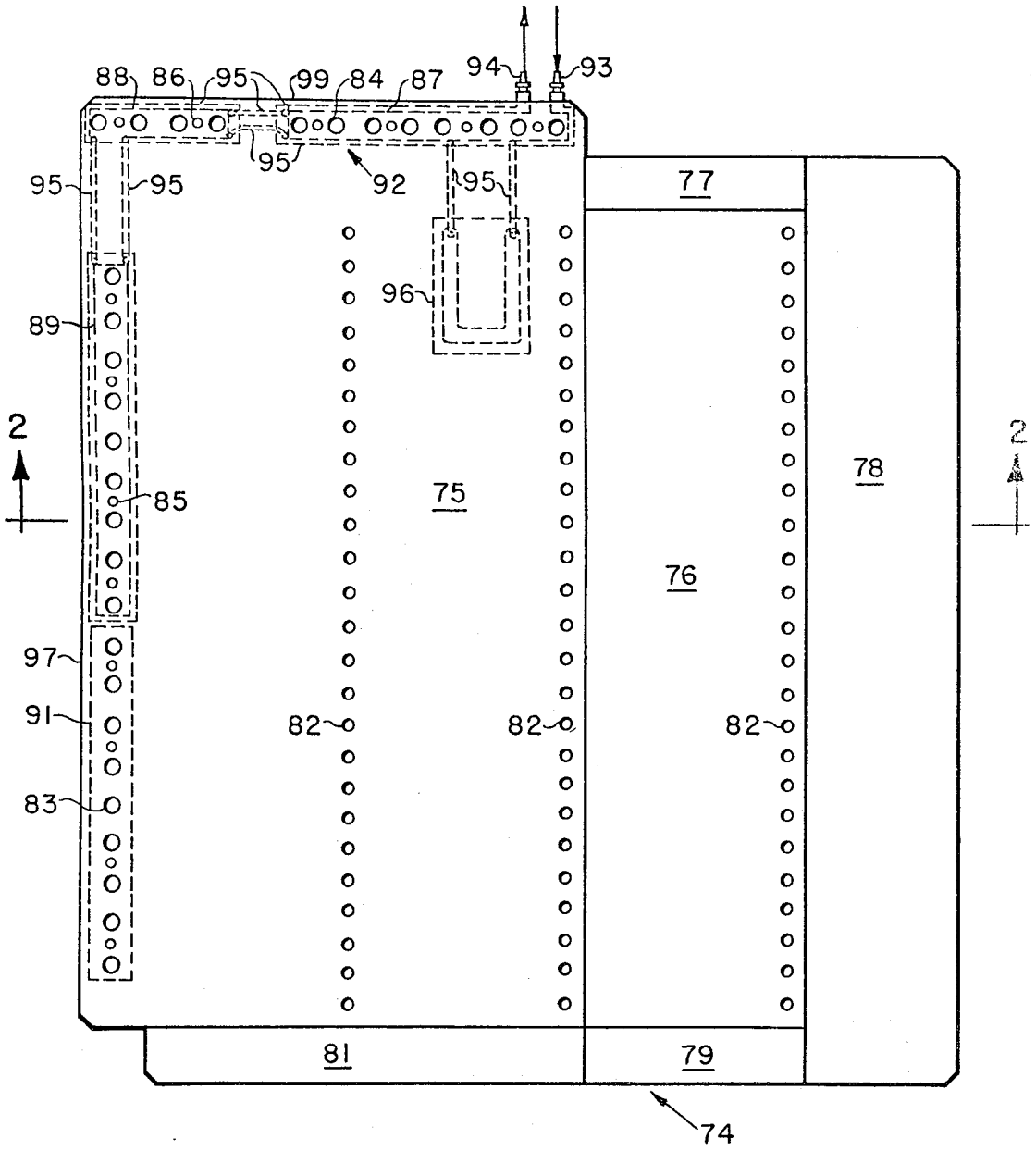
FIG. 1 is a plan view of the novel anode base structure. The anode blades are not shown for clarity.
Figure 2:
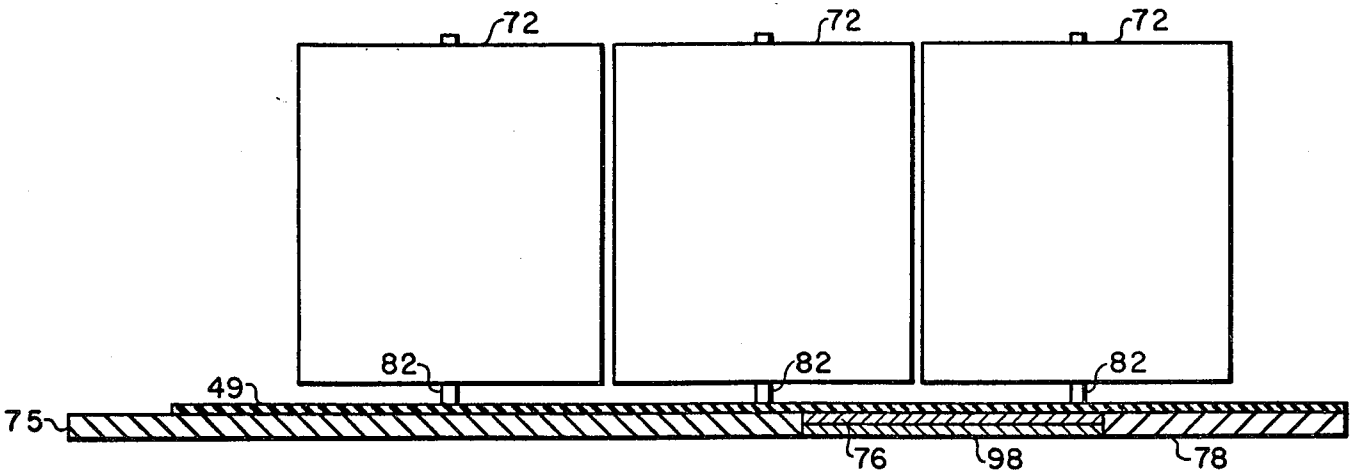
FIG. 2 is a side elevation view of the anode base structure of FIG. 1 along plane 2—2 and shows the highly conductive metal plate configuration detail.

Referring now to FIGS. 1 and 2, anode base structure 74 comprises copper plates 75 and copper plate 76 and can also comprise steel plates 77, 78, 79, 81 and 98 or any other suitable structural means. Copper plates 75 and 76 and steel plates 77, 78, 79 and 81 and 98 are connected in any suitable manner, as by bolting or welding, to provide a unitary structure having suitable structural support means. Anode base structure 74 can be protected from corrosion by elastomeric sealing pad 49. Copper plates 75 and 76 can be provided with anode blade attachment means 82 which can be used to attach anode blades 72 to copper plates 75 and 76.

Anode blades 72 can be fabricated from any suitable electrically conductive material which will resist the corrosive attack of the various cell reactants and products with which they may come in contact. Anode blades 72 are preferably metallic anode blades. Typically, anode blades 72 can be fabricated from a so-called valve metal, such as titanium, tantalum or niobium as well as alloys of these in which the valve metal constitutes at least about 90 percent of the alloy. The surface of the valve metal may be made active by means of a coating of one or more noble metals, noble metal oxides, or mixtures of such oxides, either alone or with oxides of the valve metal. The noble metals which may be used include ruthenium, rhodium, palladium, iridium, and platinum. Particularly preferred metal anodes are those formed of titanium and having a mixed titanium oxide and ruthenium oxide coating on the surface, as is described in U.S. Pat. No. 3,632,498. Additionally, the valve metal substrate may be clad on a more electrically conductive metal core, such as aluminum, steel, copper, or the like.

Anode blades 72 can be attached to copper plates 75 and 76 in any suitable manner as by means of nuts and/or bolts, secured projections, studs, welding, or the like. A typical method of attaching anode blades 72 to copper plates 75 and 76 can be found in U.S. Pat. No. 3,591,483.

Anode busbar 97 can be provided by attaching steel contact plates 89 and 91 using means 85 to copper plate 75 and providing the said steel and copper plates with holes 83 which can serve as means for attaching intercell connectors carrying electricity from an adjacent cell or leads carrying electricity from another source to anode busbar 97.

FIG. 2 shows that the configuration of the cross-section of copper plates 75 and 76 form the cross-sectional shape of a substantially stair-stepped truncated right triangle. Copper plates 75 and 76 have different relative dimensions and are positioned in such a configuration wherein copper plates 75 and 76 are adapted to carry an electric current and to maintain a substantially uniform current density through anode base structure 74 to electrical contact points adjacent to anode blades 72 without any significant voltage drop across anode base structure 74 and with the most economical power consumption in anode base structure 74. Substantially uniform current density is achieved by the configuration of the different cross-sections of copper plates 75 and 76 which form the cross-sectional shape of a substantially stair-stepped truncated right triangle where electric current is removed from the copper plates in a substantially uniform manner as the cross-section of the copper plates is decreased.

In a typical circuit of electrolytic cell, electric current is carried through intercell connectors (not shown) to anode busbar 97 of anode base structure 74. Electric current is than carried and a substantially uniform current density is maintained through anode base structure 74 without any significant voltage drop across anode base structure 74 and with the most economical power consumption in anode base structure 74. Electric current is carried and a substantially uniform current density is maintained through anode base structure 74 by means of the configuration and the different relative dimensions of copper plates 75 and 76. Electric current is thus carried through anode base structure 74 to electrical contact points where it is distributed to anode blades 72 and, under these conditions, the electric current is readily carried to all sections of anode blades 72.

The novel anode base structure makes the most economic use of invested capital, namely, the amount of copper or other suitable highly conductive metal used in the anode base structure. The configuration and different relative dimensions of the copper plates significantly reduce the amount of copper or other suitable highly conductive metal required in the anode base structure as compared to the prior art. The copper plates by means of their configuration and different relative dimensions are also adapted to carry an electric current and to maintain a substantially uniform current density through the anode base structure.

The configuration and dimensions of the copper plates can vary depending on the designed current capacity of the electrolytic cell and also can very depending on a number of factors such as the current density, the conductivity of the metal used, the amount of weld area, the fabrication costs and the like.

The novel anode base structure provides improved electrical conductivity to the anode blades thereby providing a minimum or no significant voltage drop across the anode base structure with a substantial reduction in copper or other suitable highly conductive metal expenditures as compared to the prior art.

The novel anode base structure can enable an electrolytic cell to be designed to operate as a chlor-alkali diaphragm cell at high current capacities of about 150,000 amperes and upward to about 200,000 amperes while maintaining high operating efficiencies. These high current capacities provide for high production capacities which result in high production rates for given cell room floor areas and reduce capital investment and operating costs. In addition to being capable of operation at high amperages, an electrolytic cell can also efficiently operate at lower amperages, such as about 55,000 amperes using the novel anode base structure.

Anode base structure 74 can be provided with cooling means 92. The coolant, preferably water, is circulated through cooling means 92 by entry through entrance port 93 and by passage through coolant conveying means 95. After entry through entrance port 93, the coolant is passed along steel plate 87 into and through cooling device 96 and then again along steel plate 87. The coolant is then passed along steel plate 88 and then along and around steel plate 89. The coolant is then passed along the opposite side of steel plate 89 and then along the opposite side of steel plate 88. The coolant is then passed along the opposite side of steel plate 87 and is discharged through exit port 94. Coolant conveying means 95 can be any suitable coolant conveying means such as copper tubing connecting cooling device 96 and coolant conveying channels positioned along the sides and ends of steel contact plates 87, 88 and 89. Cooling means 92 as shown in this figure and described herein is merely a typical cooling means and cooling means 92 should not be limited to the design as shown in this figure and described herein.

The use of cooling system 92 permits considerably less copper to be used in anode base structure 74 which results in a substantial reduction in capital investment costs for anode copper. While cooling system 92 is provided pimarily for use when an adjacent electrolytic cell is jumpered, cooling system 92 can be used during routine cell operation either to cool anode copper during any periodic electric current overloads or to continuously cool anode copper, thereby permitting further reductions in the use of copper in anode base structure 74 with an accompanying reduction in capital costs for anode copper.

Anode jumper busbar 99 can be provided by attaching steel contact plates 87 and 88 using means 86 to copper plate 75 and providing the said steel and copper plates with holes 84 which can serve as means for attaching anode jumper connectors when an adjacent electrolytic cell is jumpered and is removed from the electrical circuit. It is during this jumpering operation that cooling system 92 can provide its greatest utility by preventing the temperatures in anode base structure 74 from rising to levels whereby damage to anode base structure 74 or other components of the electrolytic cell occurs.

Figure 3:
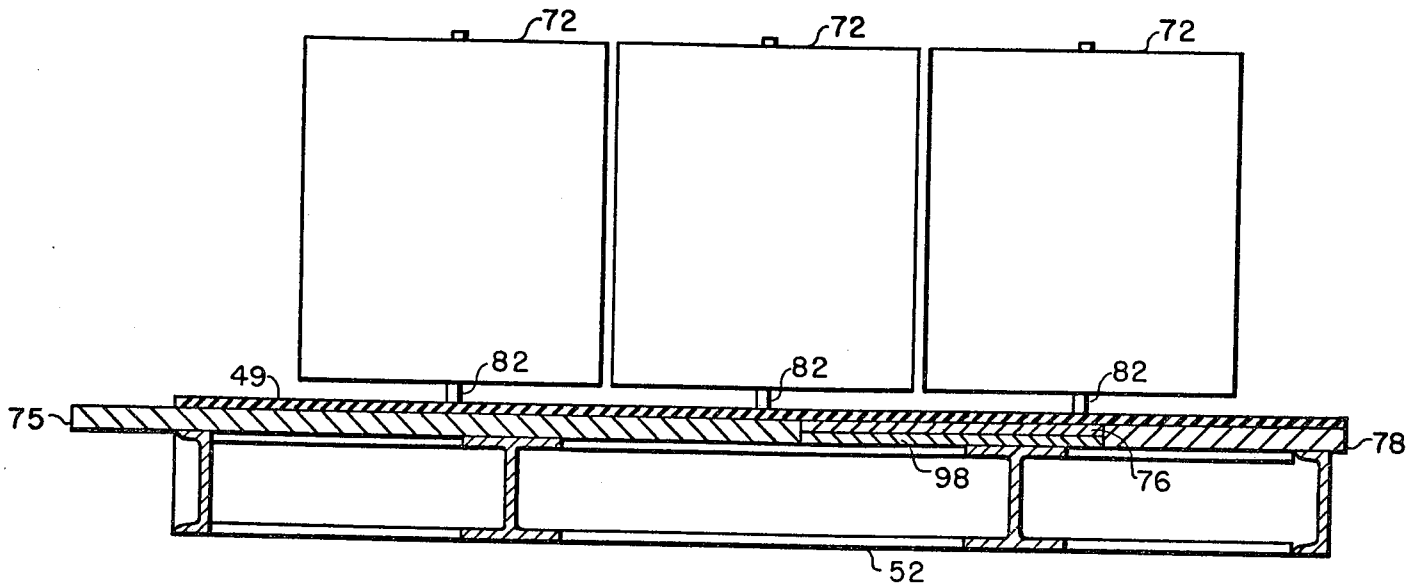
FIG. 3 is a view of FIG. 2 showing the addition of a structural cell base support means.

Referring now to FIG. 3 anode base structure 74 is shown in another embodiment wherein anode base structure 74 is provided with structural support means 52 which can supply additional structural support for anode base structure 74. This embodiment would be advantageous and preferably where anode base structure 74 is fabricated from a highly conductive metal, such as copper, which has excellent electrical properties but has relatively poor structural properties. Structural support means 52 can be fabricated from any number of suitable structural materials such as aluminum, iron, steel and the like and alloys thereof such as stainless steel and other chromium steels, nickel steels and the like, which have sufficient strength to provide the needed support. Such structural materials can have the shapes of I beams, T beams, L beams, U beams and the like. Structural support means 52 does not have to be fabricated from a metal and can be fabricated from other suitable structural materials such as concrete, reinforced concrete or the like.

Figure 4:
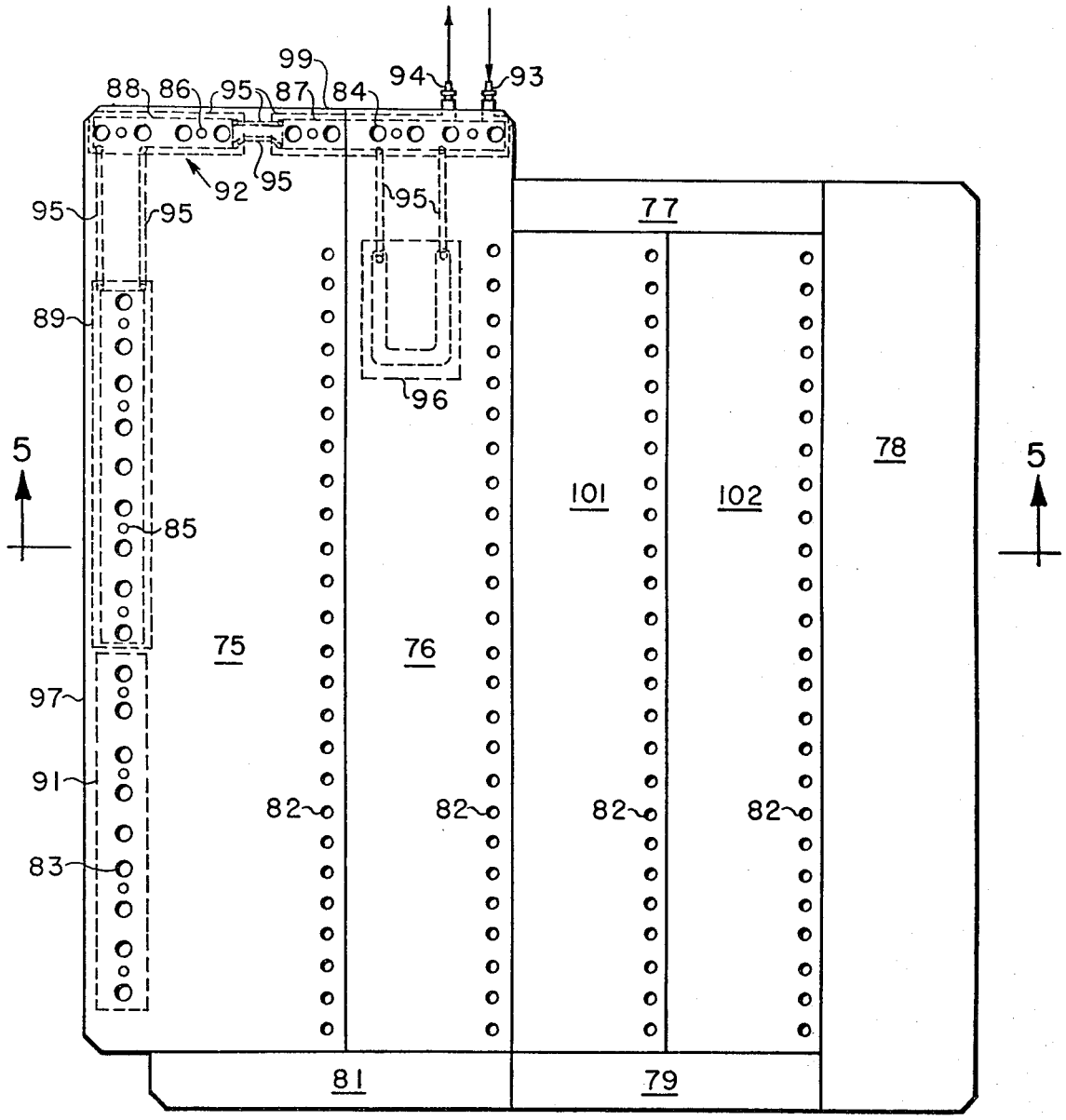
FIG. 4 is a plan view of the novel anode base structure. The anode blades are not shown for clarity.
Figure 5:
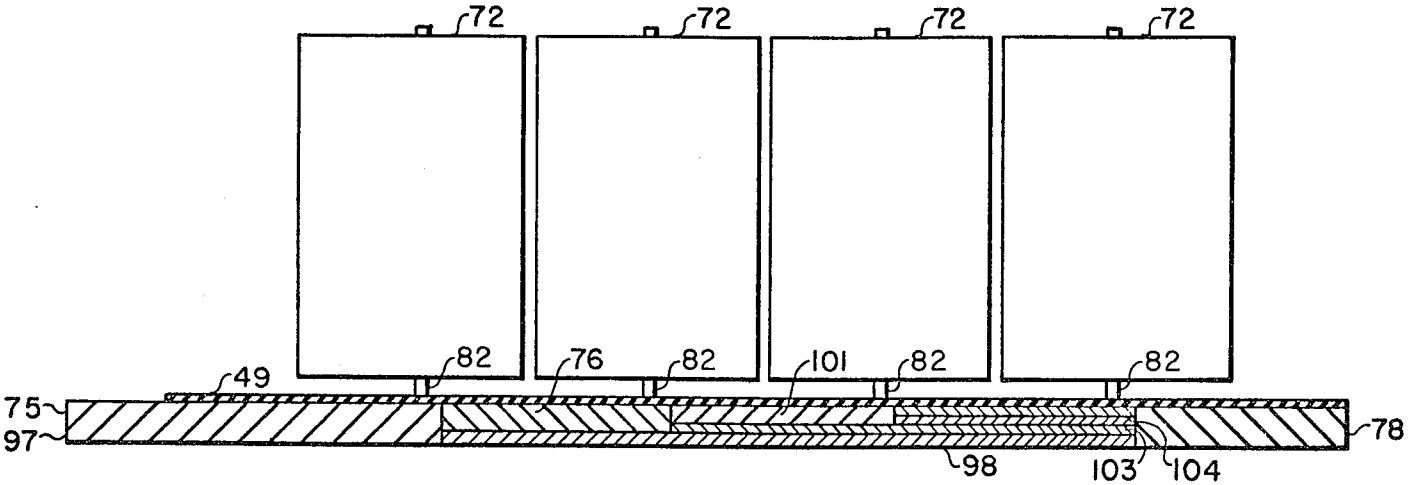
FIG. 5 is a side elevation view of the anode base structure of FIG. 4 along plane 5—5 and shows the highly conductive metal plate configuration detail.
Figure 6:
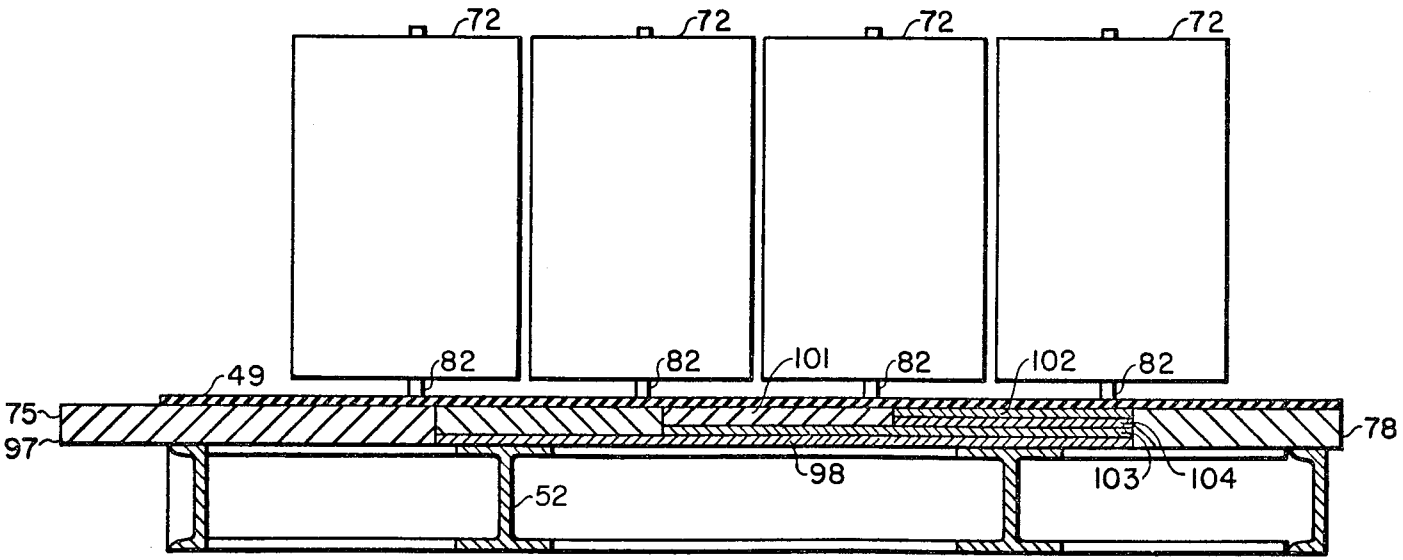
FIG. 6 is a view of FIG. 5 showing the addition of a structural cell base support means.

Referring now to FIGS. 4, 5 and 6, another embodiment of anode base structure 74, shown in FIGS. 1, 2 and 3, is shown in FIGS. 4, 5 and 6. The description of FIGS. 1, 2 and 3 applies to FIGS. 4, 5 and 6. The difference in FIGS. 4, 5 and 6 from FIGS. 1, 2 and 3 is the addition of copper plates 101 and 102 and steel plates 103 and 104. There is also the addition of a fourth row of anode blades 72 and a slight modification in cooling means 92 and jumper busbar 99.

FIGS. 5 and 6 show that the configuration of the cross-sections of copper plates 75, 76, 101 and 102 form the cross-sectional shape of a substantially stair-stepped truncated right triangle. Copper plates 75, 76, 101 and 102 have different relative dimensions and are positioned in such a configuration wherein copper plates 75, 76, 101 and 102 are adapted to carry an electric current and to maintain a substantially uniform current density through anode base structure 74 to electrical contact points adjacent to anode blades 72 without any significant voltage drop across anode base structure 74 and with the most econoical power consumption in anode base structure 74.

Substantially uniform current density is achieved by the configuration of the differenet cross-sections of copper plates 75, 76, 101 and 102 which form the cross-sectional shape of a substantially stair-stepped truncated right triangle where electric current is removed from the copper plates in a substantially uniform manner as the cross-section of the copper plates is decreased.

In a typical circuit of electrolytic cells, electric current is carried through overall connectors (not shown) to anode busbar 97 of anode base structure 74. Electric current is then carried and a substantially uniform current density is maintained through anode base structure 74 without any significant voltage drop across anode base structure 74 and with the most economical power consumption in anode base structure 74. Electric current is carried and a substantially uniform current density is maintained through anode base structure 74 by means of the configuration and the different relative dimensions of copper plates 75, 76, 101 and 102. Electric current is thus carried through anode base structure 74 to electrical contact points where it is distributed to anode blades 72, and, under these conditions, the electric current is readily carried to all sections of anode blades 72.

The novel anode base structure makes the most economic use of invested capital, namely, the amount of copper or other suitable highly conductive metal used in the anode base structure. The configuration and different relative dimensions of the copper plates significantly reduce the amount of copper or other suitable highly conductive metal required in the anode base structure as compared to the prior art. The copper plates by means of their configuration and different relative dimensions are also adapted to carry an electric current and to maintain a substantially uniform current density through the anode base structure.

The configuration and dimensions of the copper plate can vary depending on the designed current capacity of the electrolytic cell and also can vary depending on a number of factors such as the current density, the conductivity of the metal used, the amount of weld area, the fabrication costs and the like.

The novel anode base structure provides improved electrical conductivity to the anode blades thereby providing a minimum or no significant voltage drop across the anode base structure with a substantial reduction in copper or other suitable highly conductive metal expenditures as compared to the prior art.

The novel anode base structure can enable an electrolytic cell to be designed to operate as a chlor-alkali diaphragm cell at high current capacities of about 150,000 amperes and upward to about 200,000 amperes while maintaining high operating efficiencies. These high current capacities provide for high production capacities which result in high production rates for given cell room floor areas and reduce capital investment and operating costs. In addition to being capable of operation at high amperages, an electrolytic cell can also efficiently operate at lower structure amperages, such as about 55,000 amperes using the novel anode base structure.

PREFERRED EMBODIMENTS

The following Example illustrates the practice of the present invention and a mode of utilizing the present invention.

EXAMPLE

The following data is typical of the performance of an electrolytic cell provided with the novel anode base structure of the present invention operating at a current capacity of 150,000 amperes. The performance is compared with the performance of a smaller electrolytic cell of the prior art, also equipped with metal anode blades, operating at a current capacity of 84,000 amperes. Both electrolytic cells are chlor-alkali diaphragm cells.

| | 84,000 Ampere Cell of the Prior Art | 150,000 Ampere Cell Provided with the Novel Anode Base Structure of the Present Invention |
|---|---|---|
| Current Efficiency | 96.4 | 96.4 |
| Average Cell Voltage (including busbars) | 3.84 | 3.83 |
| Power - KWHDC/Ton $Cl_2$ | 2735 | 2725 |
| Cell Liquor Temperature Degrees Centigrade | 100.5 | 100.7 |
| Anolyte Temperature Degrees Centigrade | 94.5 | 94.7 |
| Percent NaOH in Cell Liquor | 11.5* | 11.5* |
| Chlorine Production - Tons/Day | 2.83 | 5.06 |
| NaOH Production - Tons/Day | 3.20 | 5.71 |
| Brine Feed - Grams/Liter | 325 | 325 |
| Current Density, Amperes/Sq. In. | 1.5 | 1.5 |

*The cells can be operated at lower caustic content in the cell liquor. This will result in greater current efficiencies.

The above data show that the electrolytic cell provided with the novel anode base structure of the present invention operates at essentially the same current efficiency, voltage and operating conditions as the smaller electrolytic cell of the prior art at the same anode current density. The electrolytic cell provided with the novel anode base structure of the present invention has a high production rate for a given cell room floor area, uses less operating labor and also has a lower capital investment per ton of chlorine produced.

This example shows that an electrolytic cell can be designed to operate at high current capacity to provide a high production capacity and a high production rate while maintaining high operating efficiencies.

An electrolytic cell provided with the novel anode base structure of the present invention can have many other uses. For example, alkali metal chlorates can be produced using the electrolytic cell by further reacting the formed caustic and chlorine outside of the cell. In this instance, solutions containing both alkali metal chlorate and alkali metal chloride can be recirculated to the electrolytic cell for further electrolysis. The electrolytic cell can be utilized for the electrolysis of hydrochloric acid by electrolyzing hydrochloric acid alone or in combination with an alkali metal chloride. Thus, the electrolytic cell is highly useful in these and many other aqueous processes.

While there have been described various embodiments of the present invention, the apparatus described is not intended to be understood as limiting the scope of the present invention. It is realized that changes therein are possible. It is further intended that each component recited in any of the following claims is to be understood as referring to all equivalent components for accomplishing the same results in substantially the same or an equivalent manner. The following claims are intended to cover the present invention broadly in whatever form the principles thereof may be utilized.

What is claimed is:

1. An anode base structure for use in an electrolytic cell comprising a highly conductive metal means and a conductive metal means, said highly conductive metal means having a substantially continuous flat and level surface, said highly conductive metal means having a vertical cross-sectional shape of a substantially stair-stepped, truncated, right triangle, said conductive metal means interfacing said highly conductive metal means along said stair stepped area to provide structural support for the highly conductive metal means.

2. The anode base structure of claim 1 wherein the highly conductive metal means is provided with means for attaching the anode blades.

3. The anode base structure of claim 1 wherein said conductive metal means comprises a configuration of metal shapes which form a unitary structure with said highly conductive metal means.

4. The anode base structure of claiim 3 wherein the metal shapes comprise steel plates.

5. The anode base structure of claim 1 wherein said anode base structure is providing with means to support the components of an electrolytic cell.

6. The anode base structure of claim 5 wherein the means to support the components of the electrolytic cell comprise structural metallic support means.

7. The anode base structure of claim 5 wherein the means to support the components of the electrolytic cell comprise structural non-metallic support means.

8. The anode base structure of claim 1 wherein the anode base structure is provided with a jumper busbar for attaching anode connector means when an adjacent electrolytic cell is jumpered and removed from the electrical circuit.

9. The anode base structure of claim 1 wherein the anode base structure is provided with a cooling means to prevent temperatures in the anode busbar structure from rising to levels whereby damage to the anode busbar structure or other components of the electrolytic cell occur.

10. The anode base structure of claim 1 wherein said highly conductive metal means is fabricated from copper.

* * * * *